US010138600B2

(12) United States Patent
Jannari et al.

(10) Patent No.: US 10,138,600 B2
(45) Date of Patent: Nov. 27, 2018

(54) FIBROUS PRODUCT AND METHOD OF PRODUCING FIBROUS WEB

(71) Applicant: Metsa Board Oyj, Metsa (FI)

(72) Inventors: Pekka Jannari, Metsa (FI); Pirita Suortamo, Metsa (FI)

(73) Assignee: METSA BOARD OYJ, Metsa (FI)

( * ) Notice: Subject to any disclaimer, the term of this patent is extended or adjusted under 35 U.S.C. 154(b) by 264 days.

(21) Appl. No.: 14/899,705

(22) PCT Filed: Jun. 23, 2014

(86) PCT No.: PCT/FI2014/050502
§ 371 (c)(1),
(2) Date: Dec. 18, 2015

(87) PCT Pub. No.: WO2014/202841
PCT Pub. Date: Dec. 24, 2014

(65) Prior Publication Data

US 2016/0186383 A1 Jun. 30, 2016

(30) Foreign Application Priority Data

Jun. 20, 2013 (FI) ..... 20135673

(51) Int. Cl.
*D21H 21/56* (2006.01)
*D21H 11/02* (2006.01)
(Continued)

(52) U.S. Cl.
CPC ..... *D21H 21/56* (2013.01); *D21H 11/02* (2013.01); *D21H 11/08* (2013.01); *D21H 11/10* (2013.01); *D21H 27/30* (2013.01)

(58) Field of Classification Search
None
See application file for complete search history.

(56) References Cited

U.S. PATENT DOCUMENTS 3,716,449 A * 2/1973 Gatward ..... D21F 11/002 162/101
3,726,449 A * 4/1973 Kern ..... D06J 1/00 223/35

(Continued)

FOREIGN PATENT DOCUMENTS

CN 1612961 A 5/2005
WO 99/15730 A1 4/1999
WO WO-2013160553 A1 * 10/2013 ..... D21H 11/18

OTHER PUBLICATIONS

"Mechnical Pulp", Smook, Gary A., Handbook of Pulp and Paper Terminology, Angus Wilde Publications, 1990, p. 75.*

(Continued)

*Primary Examiner* — Dennis R Cordray
(74) *Attorney, Agent, or Firm* — McCormick, Paulding & Huber LLP

(57) ABSTRACT

A method of producing a fiber web, and the fiber web. According to the present method, a fiber material layer is formed from fiber pulp, by using foam forming, which layer is then dried. According to the present invention, at least part of the fiber pulp is mechanical or chemi-mechanical pulp, which is ozonized before the foam forming. By using ozonization, the pulp to be foamed is improved, as regards both fiber bonding and the removal of the wood extractives, during pulp preparation. The manufactured products are suitable, for example, for end uses, where the packages are intended to be light and strong, and the properties of which ensure that the taste and smell of the products are not tainted, such as sales and storage packages for food supplies, chocolate and cigarettes.

10 Claims, 1 Drawing Sheet

(51) Int. Cl.

| | |
|---|---|
| ***D21H 11/08*** | (2006.01) |
| ***D21H 11/10*** | (2006.01) |
| ***D21H 27/30*** | (2006.01) |

(56) References Cited

U.S. PATENT DOCUMENTS

| | | | | |
|---|---|---|---|---|
| 4,120,747 | A | 10/1978 | Sarge, III et al. | |
| 4,123,317 | A | 10/1978 | Fritzvold et al. | |
| 4,279,694 | A | 7/1981 | Fritzvold et al. | |
| 5,164,045 | A | 11/1992 | Awofeso et al. | |
| 6,413,368 | B1 | 7/2002 | Dwiggins et al. | |
| 2002/0026166 | A1* | 2/2002 | Graef ..... | A61F 13/53 604/369 |
| 2002/0148584 | A1 | 10/2002 | Edwards et al. | |

OTHER PUBLICATIONS

International Search Report for PCT Serial No. PCT/FI2014/050502 dated Sep. 8, 2014.

Hostachy J-C., "Use of ozone in chemical and high yield pulping processes—Latest innovations maximizing efficiency and environmental performace", Appita Annual Conference—Appita 64—64th Appita Annual Conference and Exhibibon, Incorporating the 2010 Pan Pacific Conference—Conference Technical Papers, Edited by Appita Inc., 201, pp. 349-351.

Lecourt et al. "Saving energy by application of ozone in the thermomechanical pulping process", in International Mechanical Pulping Conference 2007, edited by TAPPI Press, 2007, pp. 494-507.

Long et al., "Kinetic Study of Ozone Treatment on Mechanical Pulp", in TAPPI Pulping/Process and Product Quality Conference, edited by TAPPI Press, 2000, 8 p.

Finnish Search Report for Serial No. 20135673 dated Mar. 18, 2014.

* cited by examiner

FIBROUS PRODUCT AND METHOD OF PRODUCING FIBROUS WEB

CROSS-REFERENCE TO RELATED APPLICATIONS

This application is entitled to the benefit of and incorporates by reference subject matter disclosed in the International Patent Application No. PCT/FI2014/050502 filed on Jun. 23, 2014 and Finnish Patent Application No. 20135673 filed on Jun. 20, 2013.

TECHNICAL FIELD

The present invention relates to the method of producing a fibre web, such as cardboard.

According to such a method, a fibre material layer is produced from fibre pulp by using foam forming techniques, which layer is then dried.

The present invention also relates to a fibre product comprising at least one dried foam layer.

BACKGROUND ART

Flexural strength is one of the most important properties of cardboard. In particular, cardboard used for packing requires strength and rigidity, which ensures that the package withstands the journey all the way to the consumer. Much is required from the cardboard to guarantee a high strength and rigidity, which runs counter to the aim of reducing the amount of raw materials.

Sufficient rigidity has previously been achieved by using a cardboard quality possessing a sufficiently high grammage. Attempts have been made to produce paper and cardboard qualities by reducing the amount of fibre and by replacing the fibres, for example, with fillers, which causes problems in ensuring the strength and rigidity.

Furthermore, in order to reduce the use of raw materials, layer structures have been developed, which exploit the form of the I-beam. In this structure, on the surface and the back side of a bulky middle layer there is a more strongly bonded layer, which is denser than the middle layer. The greater the distance is between the surface layers, the stronger the effect of the I-beam structure will be. If the cardboard is bent, elongation occurs on the convex side of the cardboard and, correspondingly, compression on the concave side. An opposing force is generated against the elongation and the compression, the strength of which force is affected by the thickness, the elasticity and the density of the layers.

Previously, a bulky middle layer has been produced by using mechanical pulps that have undergone a low level of beating.

A problem has arisen in that the more bulky/porous the middle layer is made, the fewer are the bonds between the fibres in it and the less is its internal strength. Also, a lower level of beating decreases the generation of bonds between the fibres, because the specific surface is reduced and the number of fibrils possessing setting ability is reduced, which results in reduced internal strength of the middle layer.

Weak bonding strength may result in a number of different problems in the cutting, finishing, processing and printing stages. For example, the use of sticky printing inks in offset printing results in strain in the z-direction, which may cause delamination of the cardboard, i.e. cracking in the z-plane.

Similarly, weak bonding strength increases the amount of dust in the cutting and processing stages, as well as in later treatment of the products.

A bulky structure can also be achieved by using foam forming instead of water forming. Foam forming is described for example in the publications U.S. Pat. No. 5,164,045 and WO 991573.

In this case, the fibres are mostly not orientated with the machine direction, but instead their orientation varies more in the x-y plane and the z-direction of the cardboard. Thus, the bonding is also distributed in all directions and relatively a higher strength is achieved in the z-direction.

However, foam forming does not increase the number of bonds at a given degree of grinding, which makes it necessary to use an aid to increase the strength. An existing way of increasing the strength is to apply strengthening chemicals, which, however, have negative properties, such as their high cost and the potential negative effects on the chemistry of the wet-end, as well as their weak effect and low retention.

SUMMARY

The purpose of the present invention is to eliminate at least some of the problems associated with the known technology and to generate a new solution of producing cardboard which is of high quality and which has a high rigidity, using a small amount of raw material.

The present invention is based on the idea that part or all of the pulp of the fibre material layer, which is to be foam formed, is mechanical or chemi-mechanical pulp or a mixture thereof, which is ozonised before the foam forming.

Therefore, a cardboard product or a similar fibre product, in particular a fibre product which is dried on a paper or cardboard machine, comprises at least one dried foam layer, which is comprised partially or totally of an ozonised mechanical or chemi-mechanical fibre pulp, or a mixture thereof.

In particular, the setting ability of the (chemi)mechanical pulp of the high-bulk inner layer of a multilayer cardboard is improved by ozonising, in which case it is possible to increase the bulk of the cardboard by using foam forming, and to maintain adequate important properties of strength, such as delamination strength, and minimal generation of dust during the process of cutting.

More specifically, the method according to the present invention is mainly characterised by in that at least part of the fibre pulp is mechanical or chemi-mechanical pulp, which is ozonised before the foam forming.

The fibre product according to the present invention is, in turn, characterised by in that this layer comprises ozonised mechanical or chemi-mechanical fibre pulp, or a mixture thereof.

Considerable advantages are achieved by the present invention. Accordingly, by using foam forming techniques it is possible to improve the properties of existing packaging, paper and cardboard products, and to produce different, very porous, light and smooth products. Foam forming reduces the use of water and energy and makes savings in the use of raw material.

It is possible to achieve a significant improvement in bulk and the potential benefit of ozonisation by combining the ozonisation with foam forming of the inner layer, in which case it allows a reduced use of strengthening chemicals in the fibre network structure (for example starch, or alternative adhesive polymer added at the wet-end, into the webbing or at the size press) and/or a reduced use of strengthening pulp material (for example chemical unground/ground pulp, microfibrillated pulp or nano-pulp).

By ozonising long-fibred (chemi)mechanical pulp, such as spruce or pine pulp, the setting ability is improved, and with foam forming, a bulky inner layer having a good formation which is used for a multi-layer cardboard can be produced of it. Ozonisation also contributes to the removal of wood extractives during pulp production, which is an advantage when preparing a pulp for end-uses in which smell/taste properties are critical, such as packaging for liquids, for cigarettes or sensitive foods such as chocolate.

By combining ozonisation and foam forming of (chemi) mechanical softwood pulp, it is possible to improve the competitiveness of softwood pulp, for use as raw material, compared with hardwood pulp, in producing multi-layer cardboards.

BRIEF DESCRIPTION OF DRAWINGS

Preferred embodiments are discussed below with reference to the accompanying drawings, in which.

DETAILED DESCRIPTION

It should be noted that, in the following, an application according to the new technology is described, particularly with reference to cardboard manufacture, but is not intended to limit the description and the technology only to cardboard products. It should be understood that the present invention is also applicable to production of paper products, such as multi-layer paper products, and similar fibre products.

According to the present technology, a method is generated for preparing a fibre web, where a fibre material layer is prepared from the ozonised fibre pulp by using foam forming, which fibre material layer is dried and typically formed to be part of a multi-layer product. Thus, in one preferred embodiment, a fibre layer is generated by using foam forming, which layer is arranged in between the two other layers, for example, a cardboard product layer is formed of it, such as the inner layer of a boxboard.

In one embodiment, the fibre pulp to be foam formed solely consists of ozonised pulp, but it is also possible to combine it with a usual non-ozonised mechanical pulp, chemi-mechanical pulp, chemical pulp or microfibrillated pulp, or a combination or a mixture thereof.

In one embodiment, the ozonised fibre pulp is mechanical or especially chemi-mechanical pulp, which is made from hardwood or softwood, or a mixture thereof.

The hardwood may be any suitable species of hardwood, such as birch, aspen, poplar, eucalyptus, mixed tropical hardwood, alder or a mixture of these. The softwood, in turn, can be, for example spruce or pine, or mixtures of these.

The percentage of softwood of the initial material of the mechanical and particularly the chemi-mechanical pulp, which is comprised of hardwood and softwood, in one embodiment is 20-100%, especially 50-100%, most suitably 75-100% (of the dry weight).

When the initial material comprises softwood, interesting additional advantages are achieved by the present invention. According to the present solution, the advantages of foam forming appear mainly in respect of long fibres, which in conventional forming produce a poor formation.

In the present method, the fibre material can also be sourced from different annual plants, including straw, reed, reed canary grass, bamboo, sugar cane, and grasses.

In addition to the ozone treated pulp, it is possible to use other fibres in the production of the fibre product, such as recycled cardboard fibre or paper fibre, cardboard broke or paper broke, or synthetic fibres, or microfibrillated pulp, or synthetic fibres, or mixtures thereof.

Figure 1:
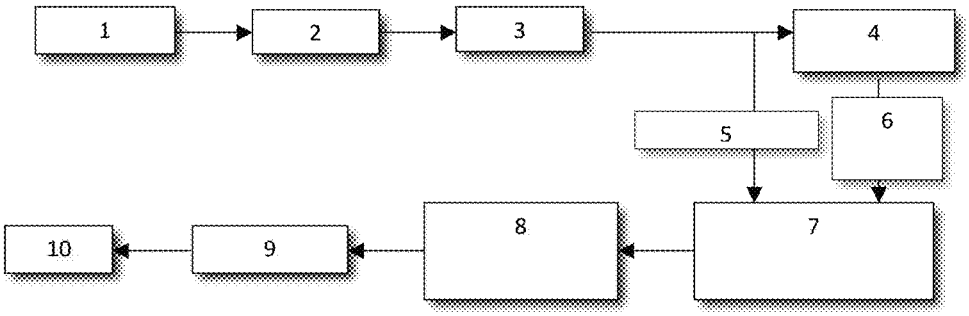
FIG. 1 shows a process flowchart according to one embodiment of the present invention.

One preferred embodiment of the new technology is illustrated in FIG. 1, which is a process flowsheet, in which the source is fibre pulp, such as mechanical or chemi-mechanical fibre pulp 1.

As described, in a preferred embodiment, the pulp is comprised of long fibre pulp. This may be sourced in particular from softwood, such as spruce or pine. The pulp 1 is fed into the ozonisation step 2. During ozonisation, the pulp is treated, in conditions which are known per se, with ozone, particularly with ozone gas, in which case an ozonised pulp 3 is generated.

The ozone in 2 can be used for treating the pulp, such as chemi-mechanical pulp, as part of the bleaching stage, either as such or together with oxygen and hydrogen peroxide, peracetic acid or chlorine dioxide.

Ozone is known to be an effective oxidiser and an efficient delignification chemical and bleaching agent.

Ozone can be dosed into either a high, medium or low consistency pulp. Processes operating with different consistencies have different operational parameters regarding temperature, pressure, pH and ozone content.

In one embodiment, ozonisation is performed at a dry matter consistency of approximately 1-50%, at a temperature of approximately 5-90° C. and using approximately 0.1-5%, especially approximately 0.1-2.5%, typically less than 2% of ozone per dry weight of the pulp. In general, the operational conditions are pressurised. In another embodiment, the pulp is treated at an average consistency (5-15% dry matter) or at a high consistency (over 15% and up to 40% dry matter).

Generally, the pulp is acidified prior to treatment. Preferably, the pH value of the aqueous phase of the fibre mass is adjusted to the acidic range of, for example, approximately 1-6.5, especially approximately 1.5-6. After that, the ozone can be brought into contact with the pulp by compressing the pulp to a higher solids content (approximately 35-50%), after which gas contact takes place at a slight overpressure, for example approximately 1.5-5 bar, especially approximately 1.6-2.5 bar. The equipment used can be a drum mixer.

In another alternative, the acidified pulp is brought into direct contact with the ozone gas, for example in a mixer or in mixers connected in a sequential series, in which case the pressure is typically higher than 5 bar, for example approximately 7-20 bar, especially approximately 10-15 bar.

The ozonisation temperature is more preferably approximately 10-40° C., in particular the operation is carried out at room temperature, i.e. approximately 15-25° C.

Typically, the residue ozone remaining in the residual gas of bleaching is disintegrated into oxygen. After that, the gas is directed back into the environment or recycled to be used for example in oxygen/ozone production.

In one embodiment, the waste gases are recycled for re-use for example in oxygen delignification.

As a result of the ozonisation 2, the setting ability of the pulp is improved. Generally, the Z-directional strength is a good measure of the setting ability and the present solution targets a strength of at least 200 kPa, especially approximately 200-600 kPa. Similarly, the Scott-Bond value should be approximately 100-500 J/m$^2$.

The ozonised pulp can be dried and baled (point 4). After that, the baled pulp can be stored 6 for a desired period of time, after which, like ordinary commercial pulp, it can be transported to a desired place of use, where it is slushed and fed into the pulp and additive system 7 of the cardboard (or paper) machine.

However, it is also possible to feed undried pulp, for example, by pumping (5) directly from the ozonisation into the pulp and additive system 7.

At the cardboard or paper machine, the pulp which is pulped or delivered in a wet condition, uses the pulp mixture which is to be foam formed for the production 8.

The pulp mixture which is to be foam formed may comprise solely ozonised pulp, or it may comprise a mix of mechanical pulp, chemi-mechanical pulp, chemical pulp, microfibrillated pulp, recycled cardboard or paper fibre or cardboard or paper broke, or synthetic fibres in mixtures of all ratios; typically, the percentage of the ozonised pulp of all fibres is, however, in cases of mixtures having at least 10%, especially approximately 20-95%, most suitably 30-90%, calculated from the dry pulp. The pulp to be foam formed may comprise mineral fillers 0-30% by weight (calculated from the dry fibre). The pulp mixture to be foam formed may also comprise synthetic fillers 0-30% by weight. The pulp to be foam formed may also comprise additives. As mentioned in the foregoing, besides surface-active agents, also additives can be used in the pulp, such as latexes, binders, colorants, corrosion inhibitors, pH regulating agents, retention auxiliary agents, beater sizing agents, and other agents common in cardboard production. The amounts of these are at maximum 20% by weight of the dry weight of the fibres.

In one embodiment, a composition suitable for foaming is obtained by mixing fibre slush, which has a consistency of approximately 0.5-7% by weight (the amount of fibre in relation to slush weight), with a foam which is formed from water and a surface-active agent and the air content of which is approximately 10-90% by volume, for example 20-80% by volume, in which case a foamed fibre slush is generated having a fibre content of approximately 0.1-3% by weight. This can be fed onto the wire in order to form a web.

The surface-active agent used may be nonionic, anionic, cationic or amphoteric. A suitable amount of surface-active agent is approximately 150-1000 ppm by weight. Examples of anionic surface-active agents are alpha-olefin sulphonates, and of nonionic, in turn, PEG-6 lauramide. Particular examples include Na-dodecyl sulphate.

During the generation of foam, the desired bubble size varies, but usually it is less than the average length of the fibre in the fibre material. Typically, the bubble size (diameter) is approximately 10-300 um, for example 20-200 um, usually approximately 20-80 um.

In the foam forming it is possible to combine, in a way which is known per se, the use of vacuum and drying which takes place on the web.

By foam forming, a foamed fibre slush that is formed of ozonised fibre, a bulky inner layer having a good formation is obtained. For this reason, the foam is fed, for example, by using a multi-layer webbing technique between two surface layers.

However, it is possible to produce a multi-layer structure by webbing the layers on top of each other, from sequential feed nozzles.

The grammages of the layers may vary freely. Generally, the weight of the surface layers is approximately 10-100 g/m$^2$, and of the middle layer approximately 10-300 g/m$^2$. By using foam forming, it is possible to keep the gram mage of the middle layer relatively low, even if the thickness of the layer is sufficient to ensure the rigidity of the product, among others, with regard to packaging applications.

The gram mage of the produced fibre product can thus vary freely for example within the range of 30-500 g/m$^2$, but, again, these are not absolute limits.

Ozone treatment can provide coarse mechanical pulp or pulp fractions with an excellent internal strength. Ozone reacts on the surfaces of the fibres, thereby adding functional groups, which contribute to the forming of the bonds between the fibres.

Because the specific surface of the pulp remains, in practice, constant during the ozone treatment, the freeness remains constant, too, even if the bonding strength increases. Therefore, it is not necessary to have a low freeness, nor a large amount of fines to achieve a good bonding, in which case the density of the sheet is not high either. Thus, ozone treatment provides a sufficient bonding strength at a higher freeness and reduces the amount of fines. Nor does the ozone affect the flexibility of the fibre in the same way as grinding. Therefore, the ozone treatment makes it possible to achieve a higher internal strength and at the same time minimum deterioration of the bulk, or, alternatively, a sufficient internal strength with a greater amount of bulk.

If the goal is to generate a greater amount of bulk, and at the same time maintain a sufficient internal strength, the produced mechanical pulp should be coarse enough (high freeness) to provide a sufficient bulk. The ozone treatment can then be used to generate sufficient strength properties.

Figure 2:
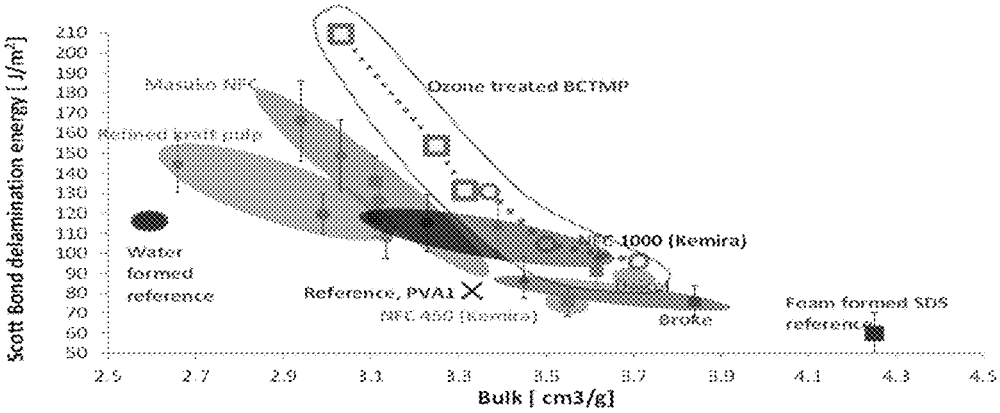
FIG. 2 shows the results of ozonisation tests carried out on bleached chemi-mechanical pulps, in which case the present technology is compared with conventional solutions, in which the intention was to improve the properties of the pulp by applying strengthening chemicals, nanocellulose and strengthening cellulose, respectively.

FIG. 2 is a schematic presentation of significant improvements in strength properties, achieved by the present invention.

The figure shows the results of comparison tests, in which case a pulp according to one embodiment of the present invention (in the figure, "Ozone treated BCTMP") was compared with pulps which are modified using traditional strength chemicals ("Daico"), nanocellulose ("NFC1", "NFC2" and "NFC3"), and corresponding strengthening cellulose ("Refined Kraft Pulp"). The treated pulps are bleached chemi-mechanical pulps. The Scott-Bond strength is expressed as a function of the bulk.

The results show that ozonisation improves the strength properties of mechanical pulp without reducing the bulk. At the same level of bulk, when the bulk is within the range 3.0-3.7 cm$^3$/g, the present technique generates an improvement of at least approximately 10%, preferably at least 15%, most suitably at least 20%, in the Scott-Bond lamination energy level (J/m$^2$) compared with the values achieved by using a traditional technique, in particular using polymeric strengthening chemicals, nanocellulose or strengthening cellulose. The comparison is based on the fact that the addition of each conventional strengthening chemical was 10%, calculated of the dry weight of the fibres of the mechanical pulp.

The properties of the achieved strength/bulk combination are unique, for example compared with the results achieved by using strength chemicals, nanocellulose and strengthening cellulose. The effect of ozonisation on the properties of pulps has been studied in the literature (see Hostachy J-C, 64*th Appita Annual Conference and Exhibition*, Appita Inc., 2010, pp. 349-351; Lecourt et al., *International Mechanical Pulping Conference* 2007, Tappi Press 2007, pp. 494-507, and Long et al. *Tappi Pulping/Process and Product Quality Conference*, Tappi Press, 2000, p. 8), but no reference can be found regarding the suitability of ozonisation for the present subject, not to mention the fact that there is no reference in the literature to the surprising and valuable results which are achieved by the present solution.

As explained above, ozonisation can also improve, besides bonding of the fibres in the foam, removal of the extractives in the wood during pulp production. This is a clear advantage in the production of pulp, for example, for end-uses in which smell/taste properties are critical. These include packaging for liquids, and sales and storage packages for food and products such as chocolate and cigarettes, which products are sensitive to package durability and other properties.

Although the foregoing describes especially the use of ozonised mechanical or chemi-mechanical pulp or a mixture thereof, in a layer generated by foam forming, which is a preferred embodiment of the present invention, it is clear that the ozonised pulp may also comprise, or even consist of chemical pulp or a mixture of chemical and mechanical and/or chemi-mechanical pulp.

As described above, by combining ozonisation and foam forming it is possible to achieve, among others, significant improvement in bulk and, at the same time, the use of strengthening chemicals for strengthening the fibre network structure can be reduced.

The manufactured products are suitable for example for end uses in which the packages are intended to be light and strong, and the properties of which ensure that the taste and smell of the products are not tainted, such as sales and storage packages for food supplies, chocolate and cigarettes.

Particularly preferred applications are food supply packages and preforms, in particular packages and package preforms which are made from long-fibred pulp.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A method of producing a fibre web comprising an inner layer and two outer layers, the method comprising ozonizing fibre pulp, which consists of mechanical or chemi-mechanical pulp, foam-forming said ozonized fibre pulp, drying said foam-formed ozonized fibre pulp to form the inner layer, and arranging the dried inner layer between the two outer layers whereby the fibre web is formed.

2. The method according to claim 1, wherein the fibre web is a paper or cardboard product.

3. The method according to claim 2, wherein the fibre web is a layer of a multilayer cardboard product.

4. The method according to claim 2, wherein the product is an inner layer of a boxboard.

5. A method of producing a fibre web comprising an inner layer and two outer layers, the method comprising ozonizing fibre pulp, which consists of mechanical or chemi-mechanical pulp or a mixture of mechanical and chemi-mechanical pulp, foam-forming said ozonized fibre pulp, drying said foam-formed ozonized fibre pulp to form the inner layer, and arranging the dried inner layer between the two outer layers whereby the fibre web is formed, wherein the mechanical and chemi-mechanical pulp is prepared from hardwood or softwood or a mixture of hardwood and softwood.

6. The method according to claim 1, wherein the ozonized fibre pulp is formed by mixing fibre pulp, the consistency of which is approximately 0.5-7% by weight, with a foam that is formed of water and a surface-active agent, and the air content of the foam is approximately 10-90% by volume, whereby a foamed fibre slush is generated, the fibre content of which is approximately 0.1-3% by weight.

7. The method according to claim 1, wherein the fibre web is a three-layer cardboard product, the inner layer of which is formed of a foamed fibre layer.

8. A three-layer cardboard fibre product wherein the inner layer is a dried foam layer that consists of ozonised mechanical or ozonized chemi-mechanical fibre pulp, or a mixture thereof.

9. The fibre product according to claim 8, that is a boxboard.

10. The fibre product according to claim 8, wherein the grammage of the foam layer is approximately 10-300 $g/m^2$, and the grammage of the cardboard fibre product is approximately 30-500 $g/m^2$.

* * * * *